US006886661B1

(12) United States Patent
Battenberg

(10) Patent No.: US 6,886,661 B1
(45) Date of Patent: May 3, 2005

(54) MOTORIZED ACCESS LADDER FOR ELEVATED AREAS

(76) Inventor: William D. Battenberg, 4715 S. Farm Rd. 141, Springfield, MO (US) 65810-1533

( * ) Notice: Subject to any disclaimer, the term of this patent is extended or adjusted under 35 U.S.C. 154(b) by 0 days.

(21) Appl. No.: 10/670,202

(22) Filed: Sep. 26, 2003

(51) Int. Cl.[7] ..... E06C 9/00
(52) U.S. Cl. ..... 182/77; 182/78
(58) Field of Search ..... 182/77, 78, 98, 182/79, 80, 81, 163, 209; 49/141

(56) References Cited

U.S. PATENT DOCUMENTS

| | | | | |
|---|---|---|---|---|
| 1,423,104 | A | 7/1922 | Glasser | |
| 1,802,401 | A * | 4/1931 | Bessler | 182/79 |
| 1,811,708 | A * | 6/1931 | Bessler | 182/78 |
| 1,811,820 | A * | 6/1931 | Bessler | 182/78 |
| 1,867,904 | A * | 7/1932 | Bessler | 182/78 |
| 1,930,992 | A | 10/1933 | Bessler | |
| 2,840,289 | A * | 6/1958 | Murray | 182/77 |
| 2,931,456 | A | 4/1960 | Harmon | |
| 3,789,955 | A | 2/1974 | Knapp | |
| 4,286,508 | A | 9/1981 | Seebo, II | |
| 5,033,584 | A | 7/1991 | Battle | |
| 5,111,906 | A | 5/1992 | Abadia | |
| 6,802,392 | B1 * | 10/2004 | Davis | 182/77 |
| 2001/0030081 | A1 | 10/2001 | Morimoto et al. | |

* cited by examiner

*Primary Examiner*—Hugh B. Thompson, II
(74) *Attorney, Agent, or Firm*—Donald R. Schoonover

(57) ABSTRACT

A ladder apparatus for providing access to an area over an elevated structure, the ladder apparatus including a housing secured to the elevated structure wherein the housing includes a housing mechanism having a central opening, a ladder pivotally mounted to the housing mechanism wherein the ladder includes a first ladder section and at least one additional ladder section slidingly mounted to the first ladder section, first motorized deploying mechanism structured to pivotally displace the ladder to and from a stored configuration and a partially deployed configuration, second motorized deploying mechanism structured to linearly displace the at least one additional ladder section to and from a partially deployed configuration and a fully deployed configuration; and control mechanism structured to operatively control the first and second motorized deploying mechanism.

10 Claims, 7 Drawing Sheets

FIG.3.
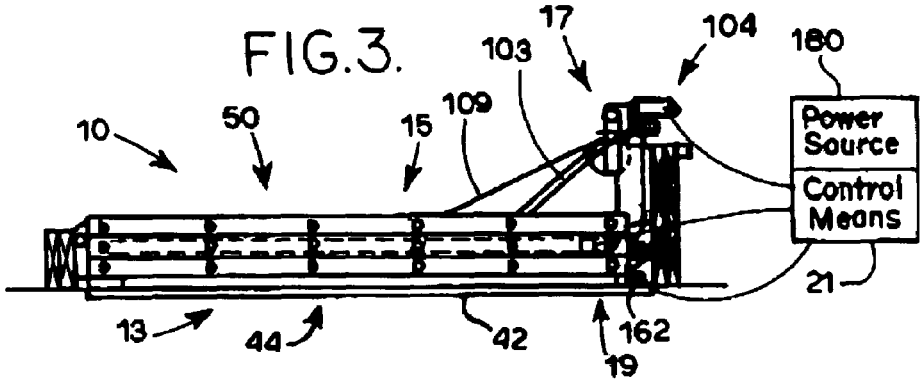
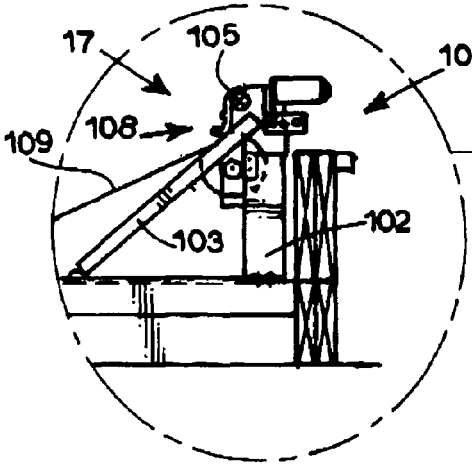
FIG. 5.
FIG. 6.
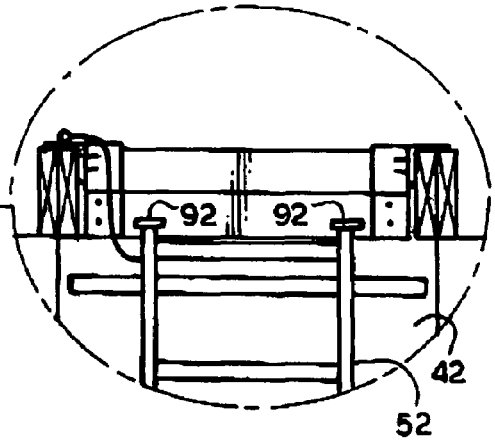

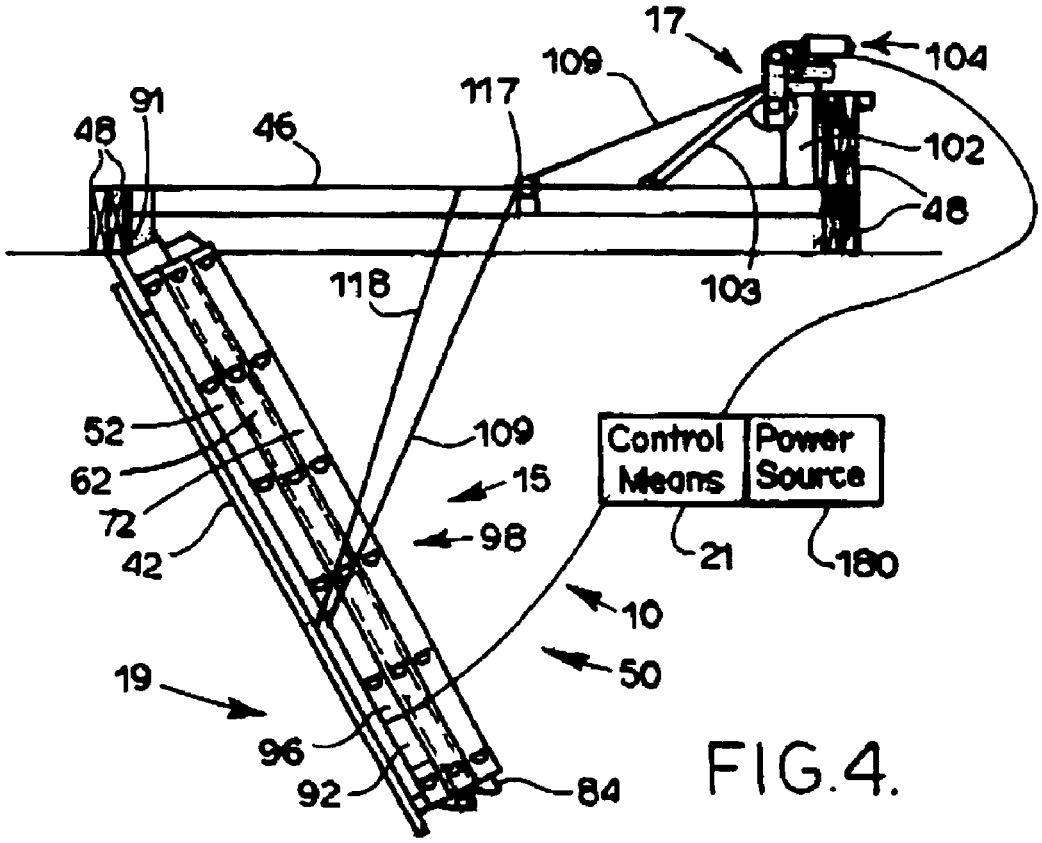
FIG.4.
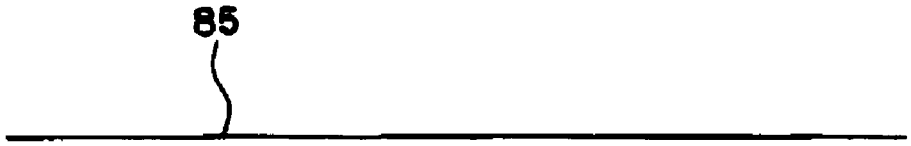

MOTORIZED ACCESS LADDER FOR ELEVATED AREAS

BACKGROUND OF THE INVENTION

1. Field of the Invention

The present invention is related to ladders and, more specifically without limitation, to access ladders.

2. Discussion of the Related Art

Regardless of the amount of space available for storage purposes, rarely is there enough space as desired for such purposes. As a result, various means have been developed to utilize otherwise inaccessible space for storage. For example, means such as pull-down stairs have been developed to provide access to space in attics and over garage ceilings. Such spaces generally provide excellent storage for seldom used articles and seasonal items, such as Christmas decorations and the like.

Unfortunately, most of the pull-down stairs available in the marketplace are constructed of wood and are limited in load capacity. Such pull-down stairs are generally manually extendable from a folded, storage configuration by pulling on a cord hanging down from one end of the stairs. As a result, these prior art pull-down stairs are difficult to handle and are somewhat dangerous, particularly for elderly or handicapped users. Also, if such pull-down stairs are not properly installed such that the joints between the sections of the stairs assume snug abutting engagements therebetween and/or the ends of the bottom section of the stairs are not accurately coped to conform to the underlying floor when the access stairs are pulled down from its storage position, a dangerous situation is created.

Previously, most garages or areas having available space thereabove had eight-foot high ceilings. More recently, many garages having available space thereabove have ceiling heights that are substantially greater than eight feet. As a result, it is not uncommon for pull-down stairs designed for eight- or ten-foot high ceilings to be installed in garages having ceilings substantially greater than ten feet. In that event, the end of the too-short access stairs is placed on a box, crate or other precarious support. A user then undertakes the very risky procedure of mounting the relatively unstable access stairs from a nearby step stool or of taking an extremely large step in order to mount the bottom step of the access stairs.

Some existing prior art access stairs have been developed wherein the stair portion thereof is extended and retracted by some type of powered arrangement. Unfortunately, the stair portion of most such prior art powered access stairs comprises a single stair section. As a result, substantial head room is required to accommodate the stair section as it is being displaced to a storage configuration above the ceiling, which not only limits the use of such powered access stairs to applications that have the necessary substantial head room but also diminishes the amount of space remaining for storage purposes.

What is needed is a motorized access ladder that has sections that do not fold for storage purposes, that does not require substantial head room when assuming a storage configuration, that provides access not only to areas over eight- or ten-foot high ceilings but also provides access to areas over ceilings or areas that have heights substantially greater than eight feet, that has feet that abuttingly engage a solid underlying surface regardless of the area height, and that is safe for all users as well as elderly and handicapped users.

SUMMARY OF THE INVENTION

The improvement of the motorized access ladder for providing access to an area over an elevated structure includes a housing mechanism, a ladder, an attachment mechanism, a first motorized deploying mechanism, a second motorized deploying mechanism, a control means, and a power source.

The housing mechanism, which is secured to the elevated structure, includes a proximal end, a distal end, opposing sides, a cental opening spaced between the proximal and distal ends and opposing sides, and a cover member pivotally connected to the proximal end of the housing mechanism wherein the cover member is dimensioned to cover the central opening as the motorized access ladder assumes a stored configuration.

The ladder includes a first ladder section having a first upper surface, a first lower surface, a first proximal end, and a first distal end; a second ladder section having a second upper surface, a second lower surface, a second proximal end, and a second distal end; and a third ladder section having a third upper surface, a third lower surface, a third proximal end, and a third distal end.

Side rails of the first, second and third ladder sections are structured such that side rails of the first ladder section are held captive between corresponding side rails of the second ladder section and the rungs of the second ladder section as the second ladder section is longitudinally displaced along the upper surface of the first ladder section. Similarly, side rails of the third ladder section are held captive between corresponding side rails of the second ladder section and the rungs of the second ladder section as the third ladder section is longitudinally displaced along the upper surface of the second ladder section.

The attachment mechanism is structured to attach the proximal end of the first ladder section to the distal end of the housing mechanism.

The first motorized deploying mechanism, which is structured to operatively displace the ladder to and from the stored configuration and a partially deployed configuration, includes a motor mounting mechanism mounted on the distal end of the housing mechanism, a first motor mechanism mounted on the motor mounting mechanism and having an output shaft, and a first drive mechanism connecting the first motor mechanism to the first ladder section to displace the ladder to and from the stored configuration and the partially deployed configuration wherein the first drive mechanism includes a reel mechanism rotationally mounted to the motor mounting mechanism, a first chain and sprockets arrangement connecting the reel mechanism to the output shaft of the first motor mechanism, and a pair of opposing first flexible members connecting the reel mechanism to the first ladder section.

The second motorized deploying mechanism, which is structured to operatively displace the ladder to and from the partially deployed configuration and a fully deployed configuration, includes a second motor mechanism mounted on a bracket and having a second output shaft, and a second drive mechanism connecting the second motor mechanism to the first and second ladder sections to positively displace the first and second ladder sections to and from the partially deployed configuration and the fully deployed configuration wherein the second drive mechanism includes a first sprocket mounted on the second output shaft and connected by a drive chain to a second sprocket that is fixedly mounted to a shaft rotationally mounted to the first ladder section. A first drive gear is fixedly mounted on the shaft and a first rack gear is fixedly mounted to, and extends the length of, a rail of the second ladder section. The second drive mechanism also includes a second drive gear fixedly mounted to the opposing end of the shaft and a second rack gear fixedly mounted to, and extending the length of, the other rail of the second ladder section. The second motorized deploying mechanism also includes a first pulley mechanism secured to the distal end of the second ladder section, a second pulley mechanism secured to the proximal end of the second ladder section, a second flexible member routed through the first pulley mechanism and connecting the distal end of the first ladder section to the proximal end of the third ladder section to thereby positively displace the third ladder section from the partially deployed configuration to the fully deployed configuration as the second ladder section is displaced from the partially deployed configuration to the fully deployed configuration, and a third flexible member routed through the second pulley mechanism and connecting the first ladder section to the proximal end of the third ladder section to thereby positively displace the third ladder section from the fully deployed configuration to the partially deployed configuration as the second ladder section is displaced from the fully deployed configuration to the partially deployed configuration.

The control means, which is structured to control the first and second motorized deploying mechanisms, includes a switch mechanism having a neutral position, a deploy position, and a retract position wherein, as the switch mechanism is moved from the neutral position to the deploy position the first motor mechanism is activated to allow the ladder to be displaced from the stored configuration to the partially deployed configuration, the first motor mechanism is automatically deactivated and the second motor mechanism is automatically activated as the ladder assumes the partially deployed configuration causing the second and third ladder sections to be displaced from the partially deployed configuration to the fully deployed configuration, and the second motor mechanism is automatically deactivated as the second and third ladder sections assume the fully deployed configuration, and, as the switch mechanism is moved from the neutral position to the retract position, the second motor mechanism is activated causing the second and third ladder sections to be displaced from the fully deployed configuration to the partially deployed configuration, the second motor mechanism is automatically deactivated and the first motor mechanism is automatically activated as the second and third ladder sections assume the partially deployed configuration causing the first flexible member to displace the ladder from the partially deployed configuration to the stored configuration, and the first motor mechanism is automatically deactivated as the ladder assumes the stored configuration.

The power source provides electrical energy to the first and second motor mechanisms and to the control mechanism.

PRINCIPAL OBJECTS AND ADVANTAGES OF THE INVENTION

The principal objects and advantages of the present invention include providing a motorized access ladder; providing such a motorized access ladder that has sections that do not fold for storage purposes; providing such a motorized access ladder that does not require substantial head room when assuming a storage configuration; providing such a motorized access ladder that provides access not only to areas over eight- or ten-foot high ceilings but also provides access to areas over ceilings or areas that have heights substantially greater than eight or ten feet; providing such a motorized access ladder that has feet that abuttingly engage a solid underlying surface regardless of the ceiling height; providing such a motorized access ladder that is safe for all as well as elderly and handicapped users; and generally providing such a motorized access ladder that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

BRIEF DESCRIPTION OF THE DRAWINGS

FIG. 3 is a side elevational and partially cross-sectional view of the motorized access ladder, showing the ladder in a stored configuration.

FIG. 4 is a side elevational and partially cross-sectional view of the motorized access ladder, showing the ladder in a partially deployed configuration.

FIG. 5 is an enlarged side elevational and partially cross-sectional view of the motorized access ladder, taken from detail 5 of FIG. 1.

FIG. 6 is an enlarged front elevational and partially cross-sectional view of the motorized access ladder, taken from detail 6 of FIG. 2.

DETAILED DESCRIPTION OF THE INVENTION

Figure 1:
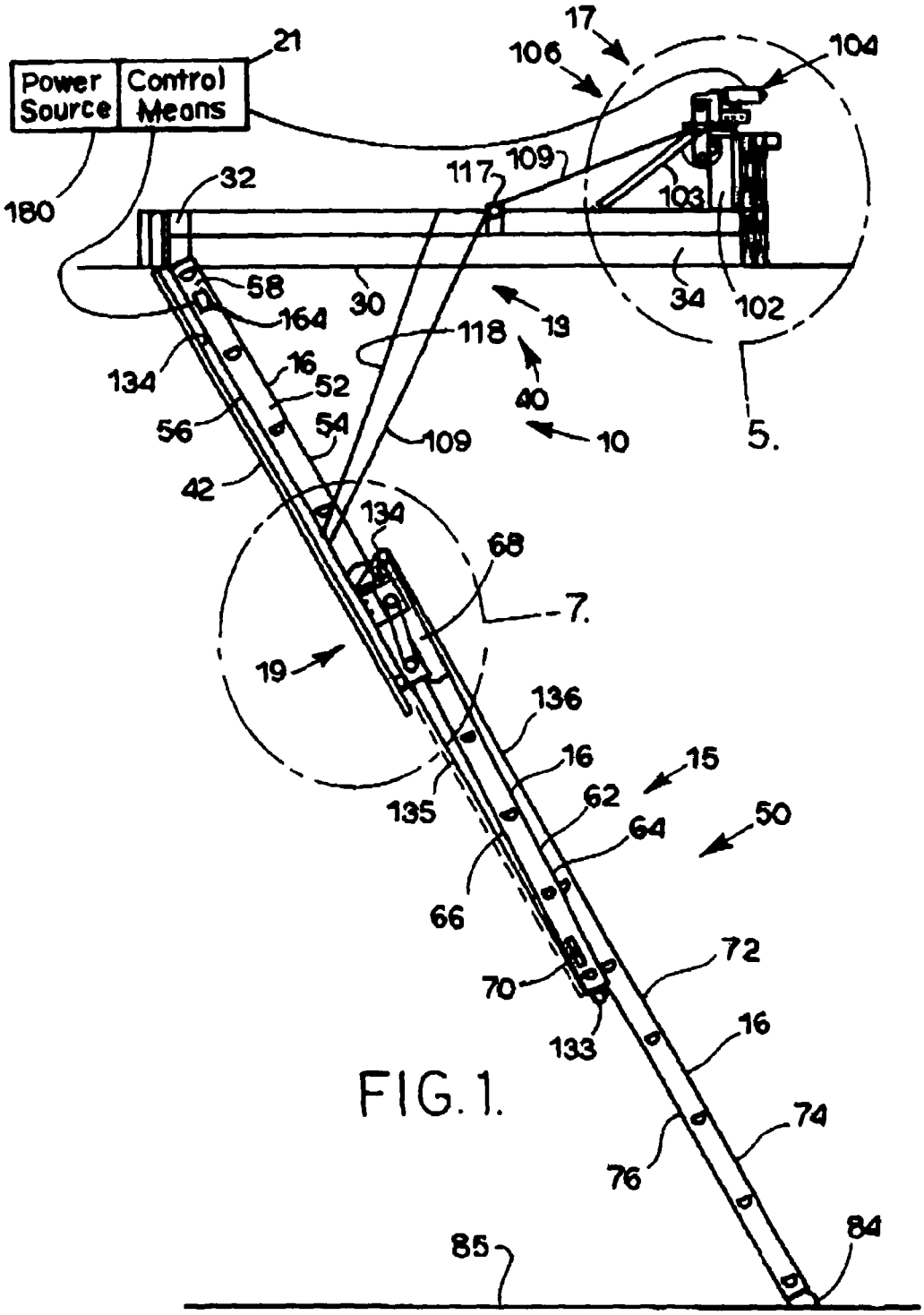
FIG. 1 is a side elevational and partially cross-sectional view of a motorized access ladder, showing a ladder thereof in a fully deployed configuration, according to the present invention.

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

The reference numeral 10 generally refers to a motorized access ladder for elevated areas in accordance with the present invention, as shown in FIGS. 1 through 11. The motorized access ladder 10 includes housing means 13 secured to an elevated structure 14, ladder means 15 pivotally mounted to the housing means 13 wherein the ladder means 13 includes two or more ladder sections 16, first motorized deploying means 17 structured to pivotally displace the ladder means 13 to and from a stored configuration and a partially deployed configuration, second motorized deploying means 19 structured to linearly displace all but one of the ladder sections 16 to and from a partially deployed configuration and a fully deployed configuration, and control means 21 structured to operatively control the first and second motorized deploying means 17, 19.

The housing means 13 includes a housing mechanism 30 having a proximal end 32, a distal end 34, opposing sides 36, 38, a central opening 40 disposed between the proximal and distal ends 32, 34 and the opposing sides 36, 38, and a cover member 42 pivotally connected to the proximal end 32 of the housing mechanism 30 and dimensioned to cover the central opening 40 as the housing mechanism 30 assumes a stored configuration 44, as shown in FIG. 3. The housing means 13 may include a reinforcing mechanism 46, such as angle iron portions or an angle iron frame for example, along the sides 36, 38 and/or proximal and distal ends 32, 34 of the housing mechanism 30 for strengthening purposes. The housing means 13 may also include blocking members 48 such as between or along joists adjacent to the housing means 13 of the elevated structure 14 as needed.

Figure 2:
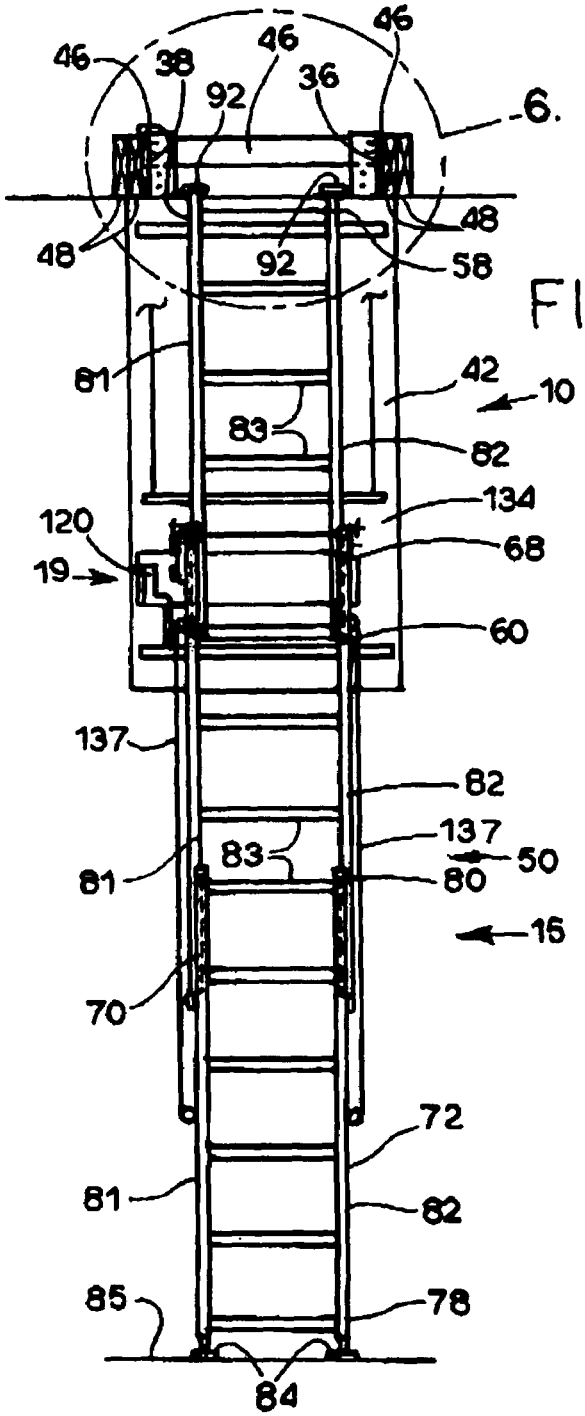
FIG. 2 is a front elevational and partially cross-sectional, fragmentary view of the motorized access ladder, showing the ladder in a fully deployed configuration.

The ladder means 15 includes a ladder 50 which has a first ladder section 52 with a first upper surface 54, a first lower surface 56, a first proximal end 58, and a first distal end 60. The ladder 50 also has a second ladder section 62 with a second upper surface 64, a second lower surface 66, a second proximal end 68, and a second distal end 70. The ladder 50 also has a third ladder section 72 with a third upper surface 74, a third lower surface 76, a third proximal end 78, and a third distal end 80. Each ladder section 52, 62, 72 has opposing side rails 81, 82 and rungs 83. The third ladder section 72 may include a pair of feet 84 pivotally mounted on distal ends of the side rails 81, 82 thereof to optimize contact between the third ladder section 72 and an underlying surface 85, such as the floor, when the motorized access ladder 10 is in a fully deployed configuration 86, as shown in FIGS. 1 and 2.

Figure 8:
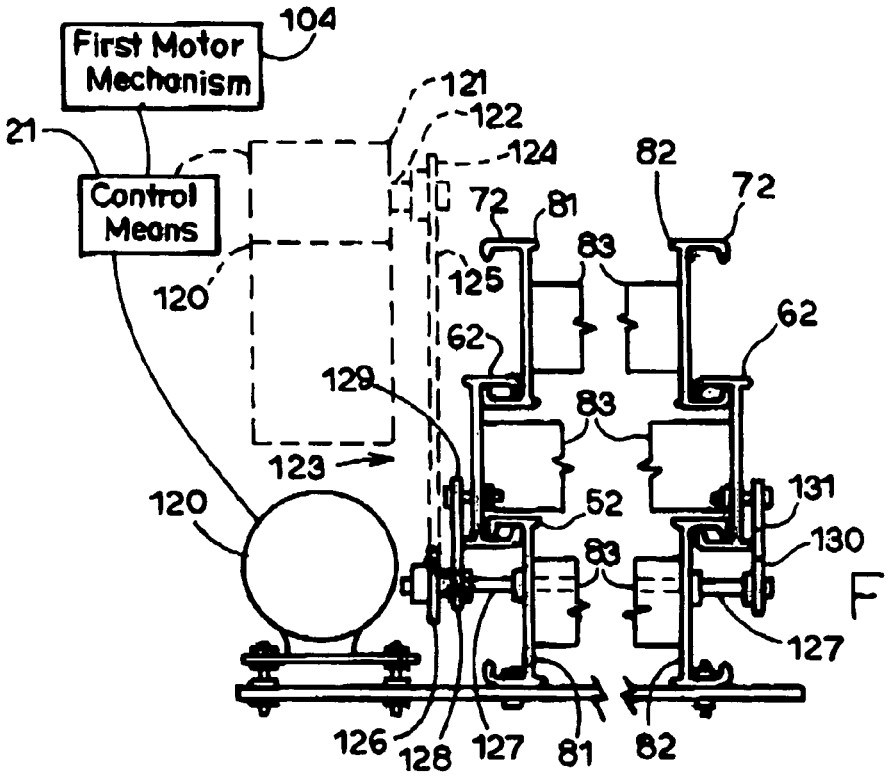
FIG. 8 is an enlarged and fragmentary end cross-sectional view of the motorized access ladder, showing a second deploying mechanism thereof and also showing, in phantom, a top view of a second drive mechanism thereof.

A cross-sectional view of the first, second and third ladder sections 52, 62, 72 is shown in FIG. 8. Each side rail 81, 82 of the first ladder section 52 is held captive between corresponding side rails 81, 82 of the second ladder section 62 and rungs 83 of the second ladder section 62 as the second ladder section 62 is displaced longitudinally along the first ladder section 52 as herein described. Similarly, each side rail 81, 82 of the third ladder section 72 is held captive between corresponding side rails 81, 82 of the second ladder section 62 and rungs 83 of the second ladder section 62 as the third ladder section 72 is displaced longitudinally along the second ladder section 62 as herein described.

It is foreseen that some applications of the present invention may not require the third ladder section 72. In that event, the second ladder section 62 may be configured to be manually lowered and raised. It is also foreseen that other applications may require embodiments that require ladder sections in addition to the second and third ladder sections 62, 72 as described herein; in other words, some applications of the present invention may require more than three ladder sections. Regardless, whether a particular application requires fewer than or more than three ladder sections, it is to be understood that such embodiments utilizing such ladder sections in the manner described herein are within the spirit and scope of the present invention.

The motorized access ladder 10 includes attachment means 91 including a pair of hinge-like first brackets 92 to pivotally attach the first proximal end 58 of the first ladder section 52 to the proximal end 32 of the housing mechanism 30 as shown in FIG. 6, and second brackets 94 structured to secure the side rails 81, 82 of first ladder section 52 to the cover member 42 with fasteners 96, such as bolts and nuts or other suitable fasteners.

The first motorized deploying means 17, which is structured to operatively displace the motorized access ladder 10 to and from the stored configuration 44 and a partially deployed configuration 98 as shown in FIG. 4, includes a motor mounting mechanism 102 mounted on the distal end 34 of the housing mechanism 30. The motor mounting mechanism 102 may also include a pair of opposing brace members 103 secured to the sides 36, 38 of the housing mechanism 30. The first motorized deploying means 17 also includes a first electric reversible motor mechanism 104 mounted on the motor mounting mechanism 102 and having a first output shaft 105, and a first drive mechanism 106 as shown in FIG. 5 connecting the first motor mechanism 104 to the first ladder section 52 to displace the ladder 50 to and from the stored configuration 44 and the partially deployed configuration 98, wherein the first drive mechanism 106 includes a reel mechanism 107 rotationally mounted to the motor mounting mechanism 102, a first chain and sprockets arrangement 108 connecting the reel mechanism 107 to the output shaft 105 of the first motor mechanism 104, and a pair of opposing first flexible members 109 connecting the reel mechanism 107 to the first ladder section 52. The length of the first flexible members 108 is sufficient to allow the angular orientation of the ladder 50 when in the fully deployed configuration 86 and the partially deployed configuration 98 to be maintained within a angular orientation generally accepted as being safe for such usage. In addition, an optional pair of opposing guide pulleys 117 may be mounted on sides 36, 38 of the housing mechanism 30 with the first flexible members 108 routed thereover, as shown in FIG. 1. Also if desired, the motorized access ladder 10 may include a pair of opposing strap brackets 118 connected between the sides 36, 38 of the housing mechanism 30 and either the cover member 42 or the first ladder section 52, as shown in FIG. 1, to prevent the ladder 50 from being displaced beyond the desired angular orientation in the fully deployed and partially deployed configurations 86, 98.

The second motorized deploying means 19, which is structured to operatively displace the motorized access ladder 10 to and from the partially deployed configuration 98 and the fully deployed configuration 86, includes a second electric reversible motor mechanism 120 mounted on a bracket that is mounted to ladder rails 81 and 82. The second motor mechanism 120 includes a gearbox 121, a second output shaft 122, and a second drive mechanism 123 as shown in a phantom top view in FIG. 8 connecting the second motor mechanism 120 to the first and second ladder sections 52, 62 to positively displace the second and third ladder sections 62, 72 to and from the partially deployed configuration 98 and the fully deployed configuration 86. The second drive mechanism 123 includes a first sprocket 124 mounted on the second output shaft 122 and drivingly connected by a drive chain 125 to a second sprocket 126 fixedly mounted to a shaft 127 rotationally mounted in rails 81, 82 of the first ladder section 52. A first drive gear 128 fixedly mounted on shaft 127 drivingly engages a first rack gear 129 that is fixedly mounted to, and extends along the length of, rail 81 of the second ladder section 62. A second drive gear 130, identical to first drive gear 128, is fixedly mounted on the opposing end of shaft 127 and drivingly engages a second rack gear 131, identical to first rack gear 129, wherein rack gear 131 is fixedly mounted to, and extends along the length of, rail 82 of the second ladder section 62, as shown in cross-section in FIG. 8.

The second motorized deploying means 19 also includes a first pulley mechanism 133 secured to the second distal end 70 of the second ladder section 62, a second pulley mechanism 134 is secured to the second proximal end 68 of the second ladder section 62, a second flexible member 135 is routed through the first pulley mechanism 133 and connects the first distal end 60 of the first ladder section 52 to the third proximal end 78 of the third ladder section 72 to thereby positively displace the third ladder section 72 from the partially deployed configuration 98 to the fully deployed configuration 86 as the second ladder section 62 is displaced from the partially deployed configuration 98 to the fully deployed configuration 86, and a third flexible member 136 is routed through the second pulley mechanism 134 and connects the first ladder section 52 to the third proximal end 78 of the third ladder section 72 to thereby positively displace the third ladder section 72 from the fully deployed configuration 86 to the partially deployed configuration 98 as the second ladder section 62 is displaced from the fully deployed configuration 86 to the partially deployed configuration 98. Preferably, the first and second motor mechanisms 104, 120 are gear driven.

If desired, a pair of opposing resilient members 137, such as coil springs 137, may be connected between the first ladder section 52 and the second ladder section 62, as shown in FIG. 2, to counter gravitational force being applied to the third ladder section 72 and thereby assist in displacing the third ladder section 72 from the fully deployed configuration 86 to the partially deployed configuration 98. The second motor mechanism 120 is shown mounted on an upper surface of a bracket that is mounted to the lower side of rails 81 and 82.

The control means 21, which is structured to control the first and second deploying means 17, 19, includes a switch mechanism 152 having a neutral position 153, a deploy position 154, and a retract position 156. For example, the switch mechanism 152 may include a two-way toggle switch 152 having a centrally located neutral position 153 wherein the deploy position 154 is selected when the switch is toggled downwardly from the neutral position 153 and the retract position 156 is selected when the switch is toggled upwardly from the neutral position 153. When the switch mechanism 152 is moved to the deploy position 154, the first motor mechanism 104 is activated to thereby allow the motorized access ladder 10 to be displaced from the stored configuration 44 to the partially deployed configuration 98, the first motor mechanism 104 is automatically deactivated and the second motor mechanism 120 is automatically activated as the motorized access ladder 10 assumes the partially deployed configuration 98 causing the second and third ladder sections 62, 72 to be displaced from the partially deployed configuration 98 to the fully deployed configuration 86, and the second motor mechanism 120 is automatically deactivated as the second and third ladder sections 62, 72 assume the fully deployed configuration 86; and, when the switch mechanism 152 is moved to the retract position 156, the second motor mechanism 120 is activated causing the second and third ladder sections 62, 72 to be displaced from the fully deployed configuration 86 to the partially deployed configuration 98, the second motor mechanism 120 is automatically deactivated and the first motor mechanism 104 is automatically activated as the second and third ladder sections 62, 72 assume the partially deployed configuration 98 causing the first flexible member 108 to displace the motorized access ladder 10 from the partially deployed configuration 98 to the stored configuration 44, and the first motor mechanism 104 is automatically deactivated as the motorized access ladder 10 assumes the stored configuration 44.

The control means 21 includes a sensing arrangement 160 to determine when the motorized access ladder 10 has assumed each of the stored, fully deployed and partially deployed configurations 44, 86, 98. An example of such a sensing arrangement 160 can be described as follows. The sensing arrangement 160 may include a push button-type switch 162 positioned such that the cover member 42 depresses the push button switch 162 as the cover member 42 closes the central opening 40 of the housing mechanism 30 thereby signaling the control means 21 that the motorized access ladder 10 has assumed the stored configuration 44 with the control means 21 then responding accordingly as described herein.

The sensing arrangement 160 may also include a mercury gravity switch 164 mounted on the ladder 50, such as on the first ladder section 52. The mercury gravity switch 164 is oriented such that the mercury gravity switch 164 closes as the ladder 50 assumes the desired deployment angular orientation as hereinbefore described whereupon the mercury gravity switch 164 signals the control means 21 that the motorized access ladder 10 has been displaced from the stored configuration 44 to the partially deployed configuration 98 with the control means 21 then responding accordingly as described herein. Adjustment of the deployment angular orientation of the partially deployed configuration 98 simply requires adjusting the orientation of the mercury gravity switch 164.

Figure 9:
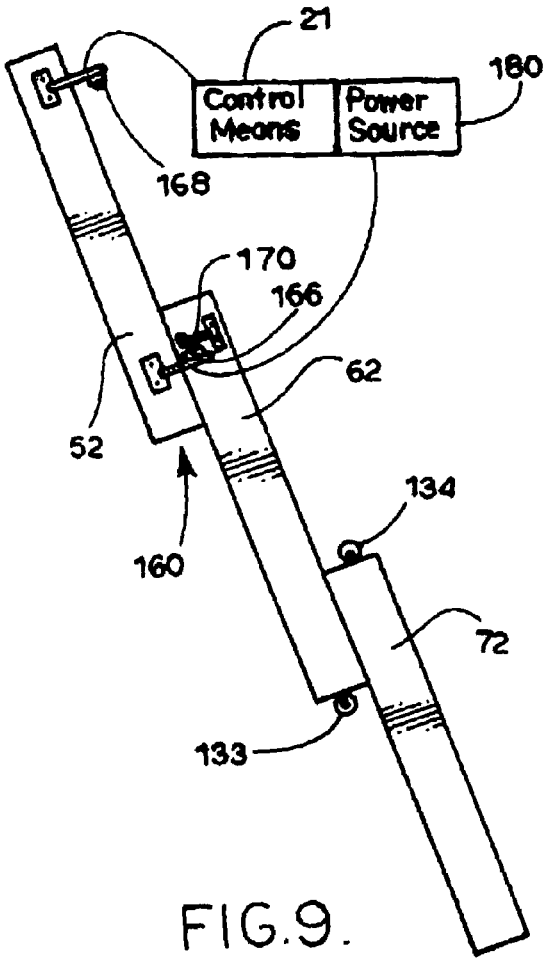
FIG. 9 is a fragmentary, side elevational and schematic view of the motorized access ladder, showing a sensing arrangement for determining the displacement of the ladder thereof from the partially deployed configuration to the fully deployed configuration.

Further, the sensing arrangement 160 may include a pair of push button-type switches 166, 168 mounted on the first ladder section 52 such as on side rail 81 thereof as shown in FIG. 9. The switch 166 is situated such that a stop 170 mounted on the corresponding side rail 81 of the second ladder section 62 depresses the push button switch 166 as the ladder 50 assumes the fully deployed configuration 86, as hereinbefore described and as schematically shown in FIG. 9, whereupon the switch 166 signals the control means 21 that the motorized access ladder 10 has been displaced from the partially deployed configuration 98 to the fully deployed configuration 86 with the control means 21 then responding accordingly as described herein. Adjustment of the extent to which the second and third ladder sections 62, 72 are linearly extended in order to assume the fully deployed configuration 86 for a particular application is accomplished by adjusting either the location of the switch 166 on the first ladder section 52 and/or the location of the stop 170 on the second ladder section 62.

Figure 10:
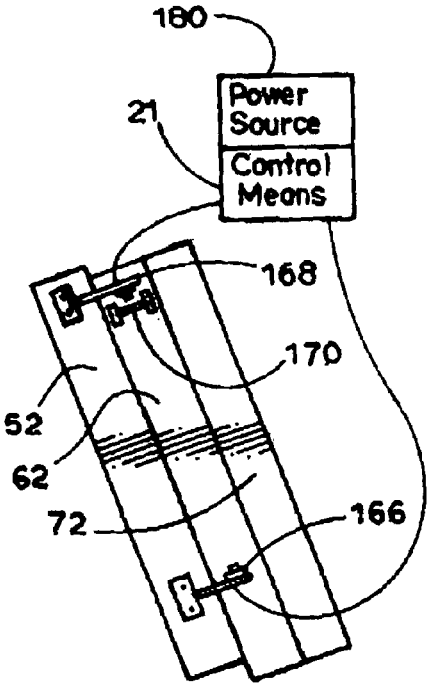
FIG. 10 is a fragmentary, side elevational and schematic view of the motorized access ladder, showing a sensing arrangement for determining the displacement of the ladder thereof from the fully deployed configuration to the partially deployed configuration.
Figure 11:
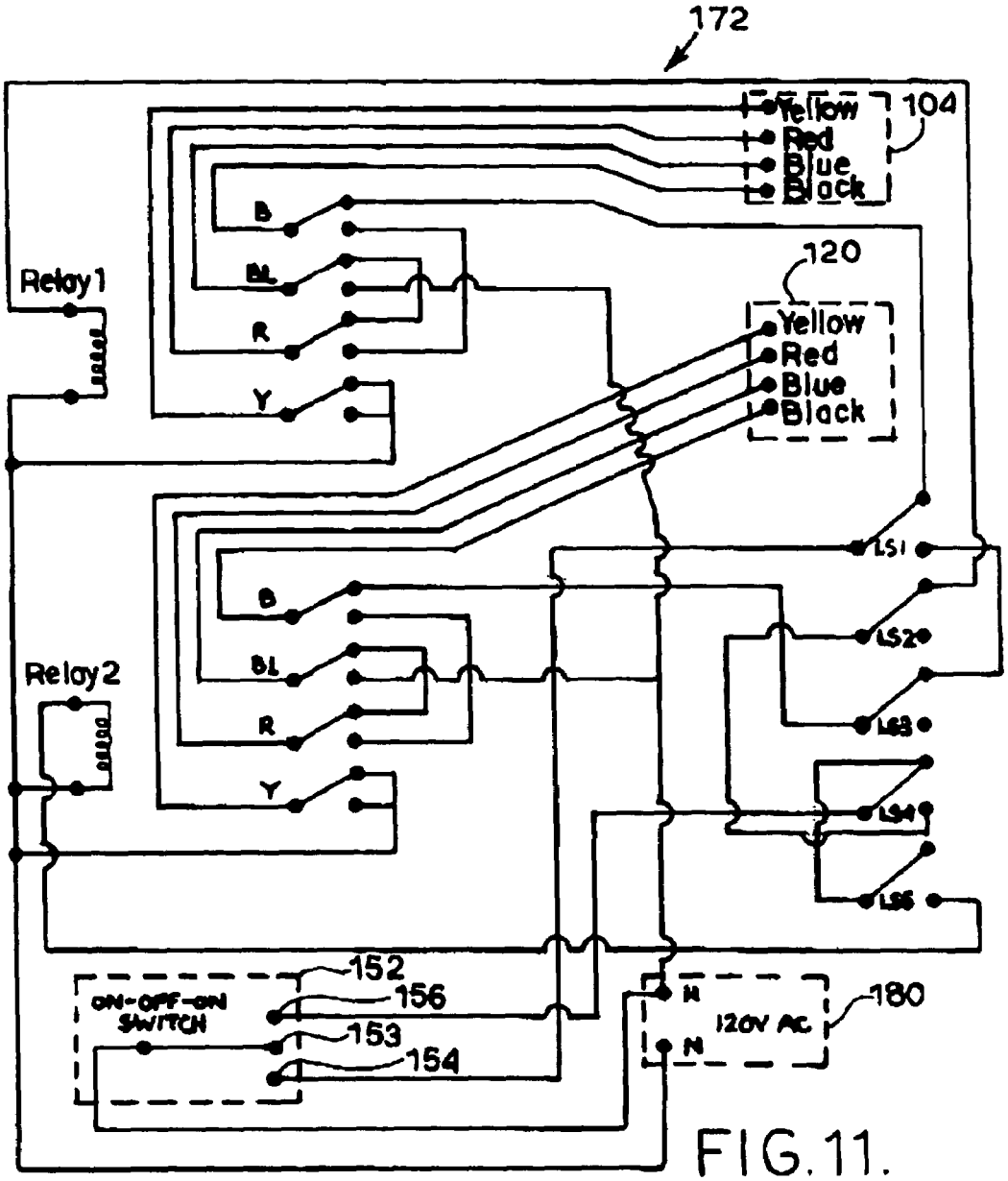
FIG. 11 is a schematic diagram of circuitry of a control mechanism of the motorized access ladder, according to the present invention.

Similarly, switch 168 is mounted on side rail 81 of the first ladder section 52 such that the stop 170 mounted on the second ladder section 62 depresses the push button switch 168 as the ladder 50 assumes the partially deployed configuration 98, as hereinbefore described and as schematically shown in FIG. 10, whereupon the switch 168 signals the control means 21 that the motorized access ladder 10 has been displaced from the fully deployed configuration 86 to the partially deployed configuration 98 with the control means 21 then responding accordingly as described herein. Adjustment of the relative positioning of the first, second and third ladder sections 52, 62, 72 to thereby define the partially deployed configuration 86 for a particular application is accomplished by adjusting either the location of the switch 168 on the first ladder section 52 and/or the location of the stop 170 on the second ladder section 62. It is to be understood that for some applications, it may be desired to use stop 170 to interact with switch 166 and a similar but different stop to interact with switch 168. An example of an electrical circuit 172 for the control means 21 for the motorized access ladder 10 is depicted in FIG. 11.

The control means 21 may be modified by methods known to those skilled in the art whereby the motorized access ladder 10 may be activated from the stored configuration 44 by a user moving the switch mechanism 152 from the neutral position 153 to the deploy position 154 and then releasing the switch mechanism 152, allowing the switch mechanism 152 to return to the neutral position 153 but with the ladder 50 continuing to be deployed until the ladder 50 reaches the fully deployed configuration 86 and remaining in the fully deployed configuration 86 until the user provides further instructions by moving the switch mechanism 152 from the neutral position 153 to the retract position 156. Similarly, motorized access ladder 10 having the modified control means 21 may be activated from the fully deployed configuration 86 by a user moving the switch mechanism 152 from the neutral position 153 to the retract position 156 and then releasing the switch mechanism 152, allowing the switch mechanism 152 to return to the neutral position 153 but with the ladder 50 continuing to be retracted until the ladder 50 reaches the stored configuration 44 and remaining in the stored configuration 44 until the user provides further instructions by moving the switch mechanism 152 from the neutral position 153 to the deploy position 154.

A power source 180, such as an electrical circuit of the structure in which the motorized access ladder 10 is installed, may be used to provide electrical energy for the first and second motor mechanisms 104, 120 and the control means 21.

Figure 12:
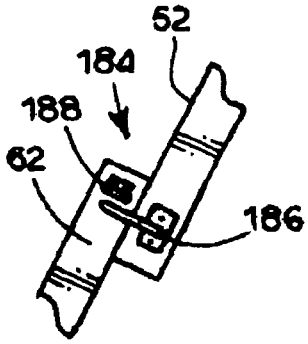
FIG. 12 is a fragmentary, side elevational and schematic view of the motorized access ladder, showing a mechanical safety stop thereof, according to the present invention.
Figure 7:
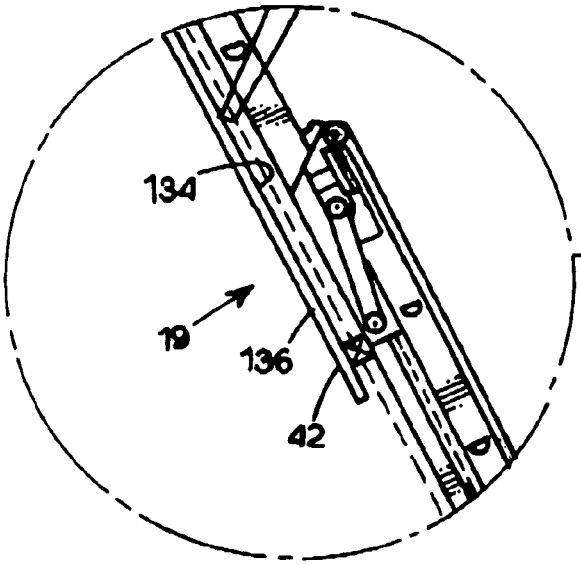
FIG. 7 is an enlarged side elevational view of the motorized access ladder, taken from detail 7 of FIG. 1.

The motorized access ladder 10 may include a mechanical safety stop 184 having a first portion 186 mounted on the first ladder section 52 and a second portion 188 mounted on the second ladder portion 62, wherein the first portion 186 and the second portion 188 are spaced to physically interact with each other, as shown in FIG. 12, to thereby prevent the second and third ladder sections 62, 72 from extending beyond the fully deployed configuration 86.

In an application of the present invention, the motorized access ladder 10 is installed in a hole through the ceiling of a desired storage area of a building structure with blocking members 48 installed to provide necessary support for the intended purpose. A power source 180 is connected to the motorized access ladder 10 to appropriately provide electrical energy to the various components of the motorized access ladder 10, such as the first motor mechanism 104, the second motor mechanism 120, and the control means 21. The switch mechanism 152 is installed at a location convenient to a user. Normally, the motorized access ladder 10 remains out of the way in the stored configuration 44 until needed.

When a user desires to obtain access to the overhead storage area, the user simply moves the switch mechanism 152 from the neutral position 153 to the deploy position 154 whereupon the first motorized deploying mechanism 17 is activated and displaces the motorized access ladder 10 from the stored configuration 44 to the partially deployed configuration 98. As the motorized access ladder 10 assumes the partially deployed configuration 98 from the stored configuration 44, the first motorized deploying mechanism 17 is deactivated and the second motorized deploying mechanism 19 is activated and displaces the motorized access ladder 10 from the partially deployed configuration 98 to the fully deployed configuration 86 by extending the second and third ladder sections 62, 72 longitudinally outwardly from first ladder section 52. As the motorized access ladder 10 assumes the fully deployed configuration 86 from the partially deployed configuration 98, the second motorized deploying mechanism 19 is deactivated. During installation or first use of the motorized access ladder 10, switch 164 may be adjusted if necessary to ensure that the orientation of the motorized access ladder 10 while in the fully deployed and partially deployed configurations 86, 98 assumes the recommended angular orientation for safe ladder usage as hereinbefore described. Additionally, switch 166 and/or stop 170 may be adjusted to ensure that the extent to which the second and third ladder sections 62, 72 are extended longitudinally outwardly from first ladder section 52 is appropriate for the recommended angular orientation for safe ladder usage and the ceiling height of that particular application of the present invention.

When access to the overhead area is no longer needed and the user desires to move the ladder 50 out of the way and out of sight, the user simply moves the switch mechanism 152 from the neutral position 153 to the retract position 156 whereupon the second motorized deploying mechanism 19 is activated and displaces the motorized access ladder 10 from the fully deployed configuration 86 to the partially deployed configuration 98. As the motorized access ladder 10 assumes the partially deployed configuration 98 from the fully deployed configuration 86, the second motorized deploying mechanism 19 is deactivated and the first motorized deploying mechanism 17 is activated and displaces the motorized access ladder 10 from the partially deployed configuration 98 to the stored configuration 44. As the motorized access ladder 10 assumes the stored configuration 44 from the partially deployed configuration 98, the first motorized deploying mechanism 17 is deactivated.

One of the advantages of the motorized access ladder 10 over other prior art powered access stairs is the minimal space removed from the overhead area for storage of the motorized access ladder 10—approximately eighteen inches in one application of the present invention—and that being required only in and immediately above the central opening 40 that provides through-access to the overhead area.

It is to be understood that while certain forms of the present invention have been illustrated and described herein, it is not to be limited to the specific forms or arrangement of parts described and shown.

What is claimed and desired to be covered by Letters Patent is as follows:

1. A ladder apparatus for providing access to an area over an elevated structure, comprising:

(a) a housing secured to the elevated structure wherein the housing includes a housing mechanism having a proximal end, a distal end, opposing sides, and a central opening disposed between the proximal end, the distal end, and the opposing sides;

(b) a ladder pivotally mounted to the housing mechanism, the ladder including a first ladder section and at least one additional ladder section mounted to the first ladder section;

(c) first motorized deploying means for pivotally displacing the ladder to and from a stored configuration and a partially deployed configuration;

(d) second motorized deploying means for longitudinally displacing the at least one additional ladder section to and from a partially deployed configuration and a fully deployed configuration;

(e) control means for controlling the first and second motorized deploying means; and (f) a power source providing electrical energy to the first and second motorized deploying means and to the control means.

2. The ladder apparatus as described in claim 1, wherein the housing mechanism has a pivotally mounted cover member dimensioned to cover the central opening as the ladder apparatus assumes a stored configuration.

3. The ladder apparatus as described in claim 1, wherein the ladder includes:

(a) the first ladder section having a first upper surface, a first lower surface, a first proximal end, and a first distal end; and (b) the at least one additional ladder section mounted to the first ladder section includes:

(1) a second ladder section having a second upper surface, a second lower surface, a second proximal end, and a second distal end wherein the second ladder section is connected to the first ladder section such that the lower surface of the second ladder section is longitudinally displaceable along the upper surface of the first ladder section, and (2) a third ladder section having a third upper surface, a third lower surface, a third proximal end, and a third distal end wherein the third ladder section is connected to the second ladder section such that the lower surface of the third ladder section is longitudinally displaceable along the upper surface of the second ladder section.

4. The ladder apparatus as described in claim 3, including an attachment mechanism structured to pivotally attach the first proximal end of the first ladder section to the proximal end of the housing mechanism.

5. The ladder apparatus as described in claim 4, wherein the first motorized deploying means includes:

(a) a motor mounting mechanism mounted on the distal end of the housing mechanism;

(b) a first motor mechanism mounted on the motor mounting mechanism and having a first output shaft; and (c) a first drive mechanism connecting the first motor mechanism to the first ladder section to operatively displace the ladder to and from the stored configuration and the partially deployed configuration.

6. The ladder apparatus as described in claim 5, wherein the first drive mechanism includes:

(a) a reel mechanism rotationally mounted to the motor mounting mechanism, (b) a first chain and sprocket arrangement connecting the reel mechanism to the first output shaft of the first motor mechanism, and (c) a pair of opposing first flexible members connecting the reel mechanism to the first ladder section.

7. The ladder apparatus as described in claim 4, wherein the second motorized deploying means includes:

(a) a second motor mechanism mounted to the first ladder section and having a second output shaft; and (b) a second drive mechanism connecting the second motor mechanism to the first and second ladder sections to positively displace the second and third ladder sections to and from the partially deployed configuration and the fully deployed configuration.

8. The ladder apparatus as described in claim 7, wherein the second drive mechanism includes:

(a) a first sprocket mounted on the second output shaft;

(b) a second sprocket fixedly mounted on a shaft rotationally mounted to the first ladder section;

(c) a drive chain drivingly connecting the first sprocket to the second sprocket;

(d) a first rack gear fixedly mounted to and extending the length of the second ladder section;

(e) a first drive gear fixedly mounted on the shaft and drivingly engaging the first rack gear;

(f) a first pulley mechanism secured to the second distal end of the second ladder section;

(g) a second pulley mechanism secured to the second proximal end of the second ladder section;

(h) a second flexible member routed through the first pulley mechanism and connecting the first distal end of the first ladder section to the third proximal end of the third ladder section to thereby positively displace the third ladder section from the partially deployed configuration to the fully deployed configuration as the second ladder section is displaced from the partially deployed configuration to the fully deployed configuration; and (i) a third flexible member routed through the second pulley mechanism and connecting the first ladder section to the third proximal end of the third ladder section to thereby positively displace the third ladder section from the fully deployed configuration to the partially deployed configuration as the second ladder section is displaced from the fully deployed configuration to the partially deployed configuration.

9. The ladder apparatus as described in claim 4, wherein the control means includes a switch mechanism having a neutral position, a deploy position, and a retract position, wherein (a) as the switch mechanism is moved from the neutral position to the deploy position:

(1) the first motorized deploying means is activated to thereby allow the ladder to be displaced from the stored configuration to the partially deployed configuration, (2) the first motorized deploying means is automatically deactivated and the second motorized deploying means is automatically activated as the ladder assumes the partially deployed configuration from the stored configuration causing the second and third ladder sections to be displaced from the partially deployed configuration to the fully deployed configuration, and (3) the second motorized deploying means is automatically deactivated as the second and third ladder sections assume the fully deployed configuration; and (b) as the switch mechanism is moved from the neutral position to the retract position:

(1) the second motorized deploying means is activated causing the second and third ladder sections to be displaced from the fully deployed configuration to the partially deployed configuration, (2) the second motorized deploying means is automatically deactivated and the first motorized deploying means is automatically activated as the second and third ladder sections assume the partially deployed configuration from the fully deployed configuration causing the first flexible member to displace the ladder from the partially deployed configuration to the stored configuration, and (3) the first motorized deploying means is automatically deactivated as the ladder assumes the stored configuration.

10. A ladder apparatus for providing access to an area over an elevated structure, comprising:

(a) a housing mechanism secured to the elevated structure, the housing mechanism including a proximal end, a distal end, opposing sides, a central opening disposed between the proximal and distal ends and opposing sides, and a cover member pivotally connected to the proximal end of the housing mechanism and dimensioned to cover the central opening as the ladder apparatus assumes a stored configuration;

(b) a ladder, including:

(1) a first ladder section having a first upper surface, a first lower surface, a first proximal end, and a first distal end;

(2) a third ladder section having a third upper surface, a third lower surface, a third proximal end, and a third distal end;

(3) a second ladder section having a second upper surface, a second lower surface, a second proximal end, and a second distal end, wherein the second ladder section is structured to hold the first ladder section captive as the second ladder section is longitudinally displaced along the upper surface of the first ladder section, and wherein the second ladder section is further structured to hold the third ladder section captive as the third ladder section is longitudinally displaced along the upper surface of the second ladder section;

(2) a third ladder section having a third upper surface, a third lower surface, a third proximal end, a third distal end, and a second connecting mechanism structured to connect the third ladder section to the second ladder section whereat the lower surface of the third ladder section is longitudinally displaceable along the upper surface of the second ladder section;

(c) an attachment mechanism structured to attach the first proximal end of the first ladder section to the proximal end of the housing mechanism;

(d) a first deploying mechanism structured to operatively displace the ladder to and from the stored configuration and a partially deployed configuration, the first deploying mechanism including:

(1) a motor mounting mechanism mounted on the distal end of the housing mechanism, (2) a first motor mechanism mounted on the motor mounting mechanism and having a first output shaft, and (3) a first drive mechanism connecting the first motor mechanism to the first ladder section in order to operatively displace the ladder to and from the stored configuration and the partially deployed configuration, the first drive mechanism including (A) a reel mechanism rotationally mounted to the motor mounting mechanism, (B) a first chain and sprocket arrangement connecting the reel mechanism to the first output shaft of the first motor mechanism, and (C) a pair of opposing first flexible members connecting the reel mechanism to the first ladder section;

(e) a second deploying mechanism structured to operatively displace the ladder to and from the partially deployed configuration and a fully deployed configuration, the second deploying mechanism including:

(1) a second motor mechanism mounted to the first ladder section, (2) a second drive mechanism connecting the second motor mechanism to the first and second ladder sections to positively displace the second and third ladder sections to and from the partially deployed configuration and the fully deployed configuration, the second drive mechanism including:

(A) a first sprocket mounted on the second output shaft;

(B) a second sprocket fixedly mounted on a shaft rotationally mounted to the first ladder section;

(C) a drive chain drivingly connecting the first sprocket to the second sprocket;

(D) a first rack gear fixedly mounted to and extending the length of the second ladder section;

(E) a first drive gear fixedly mounted on the shaft and drivingly engaging the first rack gear;

(F) a first pulley mechanism secured to the second distal end of the second ladder section, (G) a second pulley mechanism secured to the second proximal end of the second ladder section, (H) a second flexible member routed through the first pulley mechanism and connecting the first distal end of the first ladder section to the third proximal end of the third ladder section to thereby positively displace the third ladder section from the partially deployed configuration to the fully deployed configuration as the second ladder section is displaced from the partially deployed configuration to the fully deployed configuration, and (I) a third flexible member routed through the second pulley mechanism and connecting the first ladder section to the third proximal end of the third ladder section to thereby positively displace the third ladder section from the fully deployed configuration to the partially deployed configuration as the second ladder section is displaced from the fully deployed configuration to the partially deployed configuration;

(f) control means structured to control the first and second deploying mechanisms, including:

(1) a switch mechanism having a neutral position, a deploy position, and a retract position, wherein (A) as the switch mechanism is moved from the neutral position to the deploy position:

(i) the first motor mechanism is activated to thereby allow the ladder to be displaced from the stored configuration to the partially deployed configuration, (ii) the first motor mechanism is automatically deactivated and the second motor mechanism is automatically activated as the ladder assumes the partially deployed configuration from the stored configuration causing the second and third ladder sections to be displaced from the partially deployed configuration to the fully deployed configuration, and (iii) the second motor mechanism is automatically deactivated as the second and third ladder sections assume the fully deployed configuration, and (B) as the switch mechanism is moved from the neutral position to the retract position:

(i) the second motor mechanism is activated causing the second and third ladder sections to be displaced from the fully deployed configuration to the partially deployed configuration, (ii) the second motor mechanism is automatically deactivated and the first motor mechanism is automatically activated as the second and third ladder sections assume the partially deployed configuration from the fully deployed configuration causing the first flexible member to displace the ladder from the partially deployed configuration to the stored configuration, and (iii) the first motor mechanism is automatically deactivated as the ladder assumes the stored configuration; and (g) a power source providing electrical energy to the first and second motor mechanisms and to the control means.

* * * * *